United States Patent [19]

Yamauchi et al.

[11] Patent Number: 4,696,342

[45] Date of Patent: Sep. 29, 1987

[54] PLATE-TYPE HEAT EXCHANGER

[75] Inventors: Yoshiyuki Yamauchi, Aichi; Toshio Ohara, Kariya; Toshio Takahashi, Oobu, all of Japan

[73] Assignee: Nippondenso Co., Ltd., Kariya, Japan

[21] Appl. No.: 877,730

[22] Filed: Jun. 24, 1986

[30] Foreign Application Priority Data

Jun. 28, 1985 [JP] Japan ..... 60-143373

[51] Int. Cl.[4] ..... F28D 1/02

[52] U.S. Cl. ..... 165/152; 165/166; 165/906; 165/167; 165/153

[58] Field of Search ..... 165/152, 153, 166, 167, 165/906

[56] References Cited

U.S. PATENT DOCUMENTS

| | | | |
|---|---|---|---|
| 1,429,440 | 9/1922 | Kuenz | 165/148 |
| 2,777,674 | 1/1957 | Wakeman | 257/245 |
| 2,937,856 | 5/1960 | Thomson | 257/245 |
| 3,631,923 | 1/1972 | Izeki | 165/167 |
| 4,217,953 | 8/1980 | Sonoda et al. | 165/153 |
| 4,249,597 | 2/1981 | Carey | 165/166 |
| 4,470,455 | 9/1984 | Sacca | 165/167 |

FOREIGN PATENT DOCUMENTS

| | | | |
|---|---|---|---|
| 0088316 | 9/1983 | European Pat. Off. . | |
| 2600996 | 7/1976 | Fed. Rep. of Germany | 165/166 |
| 489717 | 3/1919 | France | 165/153 |
| 813272 | 5/1937 | France . | |
| 2010517 | 2/1970 | France . | |
| 2241220 | 3/1975 | France . | |
| 798535 | 7/1958 | United Kingdom . | |
| 1277872 | 6/1972 | United Kingdom . | |
| 1460422 | 1/1977 | United Kingdom . | |

*Primary Examiner*—Albert W. Davis, Jr.
*Assistant Examiner*—Richard R. Cole
*Attorney, Agent, or Firm*—Cushman, Darby & Cushman

[57] ABSTRACT

A plate-type heat exchanger comprises a stack of flat fluid flow tubes each composed of a pair of confronting core plates joined to each other and defining a fluid flow pass therebetween, each of the core plates having an inlet hole for introducing a fluid into the fluid flow pass and an outlet hole for discharging the fluid from the fluid flow pass. Each core plate has a plurality of ribs on an inner wall surface thereof, the ribs on one of the pair of plates being held in contact with the confronting ribs on the other core plate. The ribs are present in the fluid flow pass between the joined core plates in every direction along the inner wall surface of each of the core plates. The fluid flow pass does not have any fluid passage free of ribs. Therefore, the heat exchanger has improved heat transfer efficiency, and the fluid flow tube is mechanically strong or highly resistant to pressure.

8 Claims, 9 Drawing Figures

PLATE-TYPE HEAT EXCHANGER

BACKGROUND OF THE INVENTION

The present invention relates to a plate-type heat exchanger for use in heaters, air conditioners, or the like, and more particularly to a core plate for defining a fluid tube pass in such a plate-type heat exchanger.

Conventional plate-type heat exchangers include a stack of fluid pass tubes each composed of a pair of core plates having edges joined together and formed with rows of ribs across the tube pass so as to provide fluid paths shaped for increased heat transfer efficiency. According to one known design, however, the ribs are formed in aligned rows between the fluid inlet and outlet of the fluid pass so that linear flow paths free of ribs are defined between the inlet and the outlet. Since the fluid tends to flow through such linear fluid paths from the inlet to the outlet, the heat transfer efficiency is poor. In addition, the core plates are mechanically weak along the linear flow paths between the rib rows. Another prior heat exchanger fluid tube pass, designed to overcome the problems of the aforesaid conventional fluid tube pass, is disclosed in U.S. Pat. No. 4,470,455 issued Sep. 11, 1984 to Sacca. The patented heat exchanger fluid flow pass does not have rib-free fluid passages extending longitudinally between the inlet and the outlet, but imposes increased resistance to the fluid flow from the inlet to the outlet, resulting in greater pressure loss. Another difficulty with this fluid flow pass is that it is mechanically weak along transverse rib-free lines across the fluid flow pass.

SUMMARY OF THE INVENTION

In view of the foregoing drawbacks of the prior plate-type heat exchangers, it is an object of the present invention to provide a plate-type heat exchanger having fluid flow passes each composed of a pair of core plates and free of fluid paths with no ribs.

According to the present invention, there is provided a plate-type heat exchanger comprising a stack of flat fluid flow tubes each composed of a pair of confronting core plates joined to each other and defining a fluid flow pass therebetween, each of the core plates having an inlet hole for introducing a fluid into the fluid flow pass and an outlet hole for discharging the fluid from the fluid flow pass, each core plate having a plurality of ribs on an inner wall surface thereof, the ribs on one of the pair of plates being held in contact with the confronting ribs on the other core plate, the ribs being present in the fluid flow pass between the joined core plates in every direction along the inner wall surface of each of the core plates. The fluid flow pass does not have any fluid passage free of ribs. Therefore, the heat exchanger has improved heat transfer efficiency, and the fluid flow tube is mechanically strong or highly resistant to pressure.

The above and other objects, features, and advantages of the present invention will become apparent from the following description when taken in conjunction with the accompanying drawings which illustrate preferred embodiments of the present invention by way of example.

DETAILED DESCRIPTION

Figure 8:
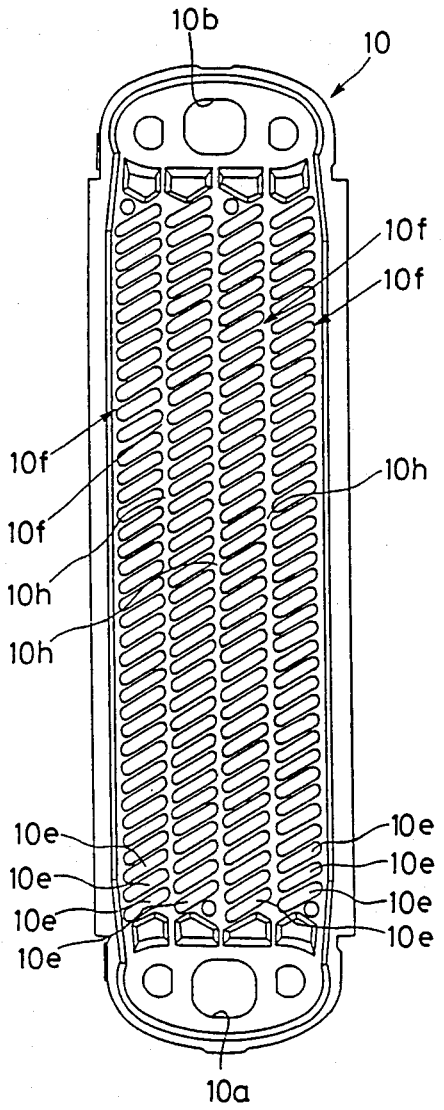
FIG. 8 PRIOR ART
FIG. 8 is a front elevational view of a conventional core plate.

FIG. 8 shows a conventional core plate 10 having an inlet hole 10*a* in one end for introducing a fluid and an outlet hole 10*b* in the other end for discharging the fluid. The core plate 10 also has rows or groups 10*f* of ribs 10*e* to fluid paths shaped for increased heat transfer efficiency. Two such core plates 10 are joined together in face-to-face relation by brazing at their peripheral edges to form a fluid flow tube which defines therein a fluid flow pass extending from the inlet hole 10*a* to the outlet hole 10*b*. The ribs 10*e* in each row are aligned between the inlet hole 10*a* and the outlet hole 10*b* so that linear flow paths free of ribs are defined between the inlet hole 10*a* and the outlet hole 10*b* inasmuch as the rib rows are symmetrical with respect to the longitudinal axis of the fluid flow pass. Since the fluid tends to flow through such linear fluid paths from the inlet hole to the outlet hole, the heat transfer efficiency is poor. In addition, the core plates are mechanically weak and hence less pressure-resistant along the linear flow paths between the rib rows.

Figure 9:
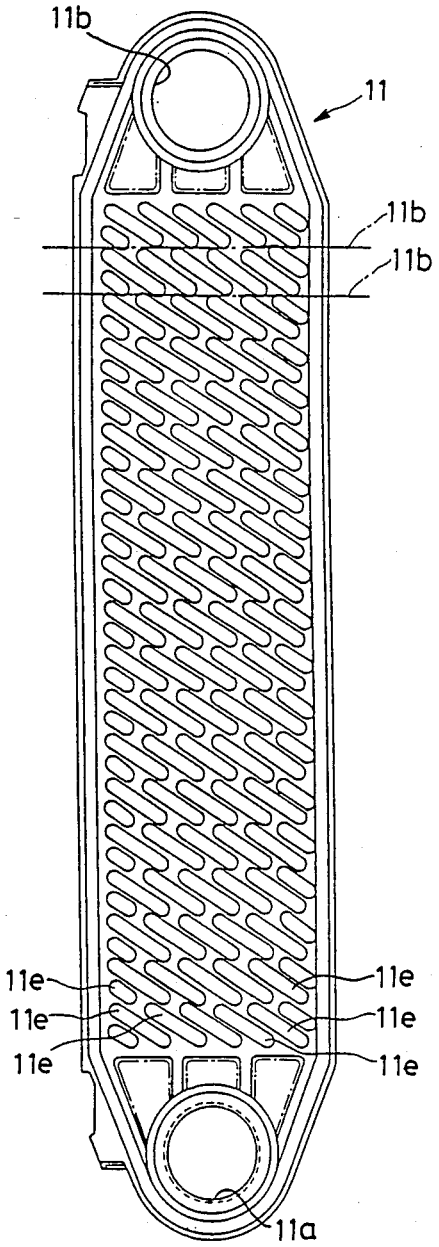
FIG. 9 PRIOR ART
FIG. 9 is a front elevational view of another conventional core plate.

Another prior heat exchanger core plate, designed to overcome the problems of the aforesaid conventional fluid tube pass, is disclosed in U.S. Pat. No. 4,470,455 issued Sep. 11, 1984 to Sacca. The disclosed core plate 11 shown in FIG. 9 has staggered groups of ribs 11*e*, and provides a fluid flow pass which does not have rib-free fluid passages extending longitudinally between an inlet hole 11*a* and an outlet hole 11*b*. However, the fluid flow pass with the staggered rib rows imposes increased resistance to the fluid flow from the inlet hole 11*a* to the outlet hole 11*b*, resulting in greater pressure loss. Another difficulty with this prior core plate is that it is mechanically weak and less pressure-resistant along transverse rib-free lines 11*b* across the fluid flow pass.

The present invention will now be described with reference to FIGS. 1 through 7.

Figure 1:
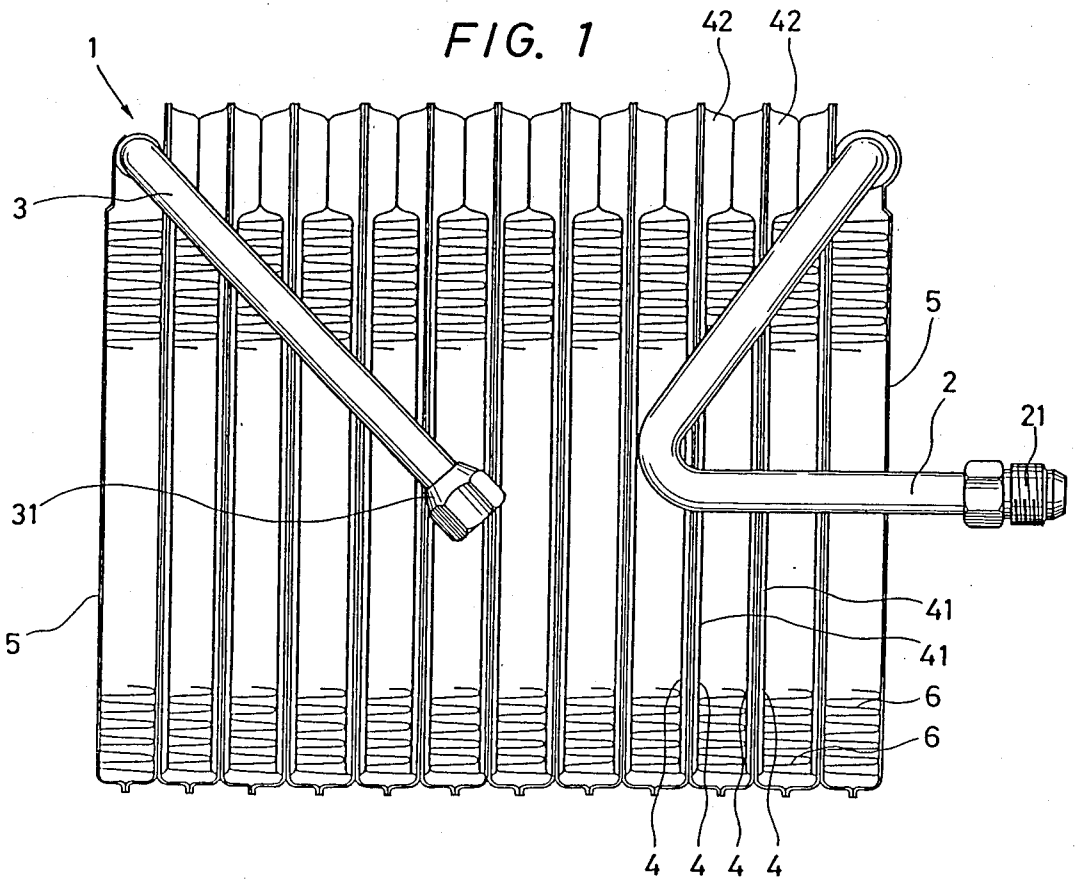
FIG. 1 is a front elevational view of a refrigerant evaporator or plate-type heat exchanger incorporating the principles of the present invention.

As shown in FIG. 1, a refrigerant evaporator or heat exchanger 1 for an automotive air conditioner is installed in an air conditioner passage defined in the instrumental panel of the passenger's compartment of an automobile. The evaporator 1 is supplied with a refrigerant (not shown) via a pipe 3 having on its free end a pipe joint 31 coupled to a pipe from the refrigerant outlet of a refrigerant compressor of the air conditioner. The refrigerant that has passed through the evaporator 1 is discharged through a pipe 2 having a pipe joint 21 coupled to a pipe from the refrigerant inlet of the refrigerant compressor.

The evaporator 1 comprises a number of flat fluid flow tubes 41 extending parallel to each other and each composed of a pair of core plates 4 joined at their peripheral edges. The fluid flow tubes 41 have on their upper end inlet tanks 42 for uniformly distributing a fluid or refrigerant into fluid flow passes 41*a* (FIG. 2) defined in the respective fluid flow tubes 41 and outlet tanks (not shown) for collecting the refrigerant that has passed through the fluid flow passes 41*a*. Each of the core plates 4 is pressed or otherwise machined from a sheet member comprising a lightweight core sheet of metal such as aluminum or brass which is a good thermal conductor, the core sheet being clad on both surfaces with a brazing material.

Figure 2:
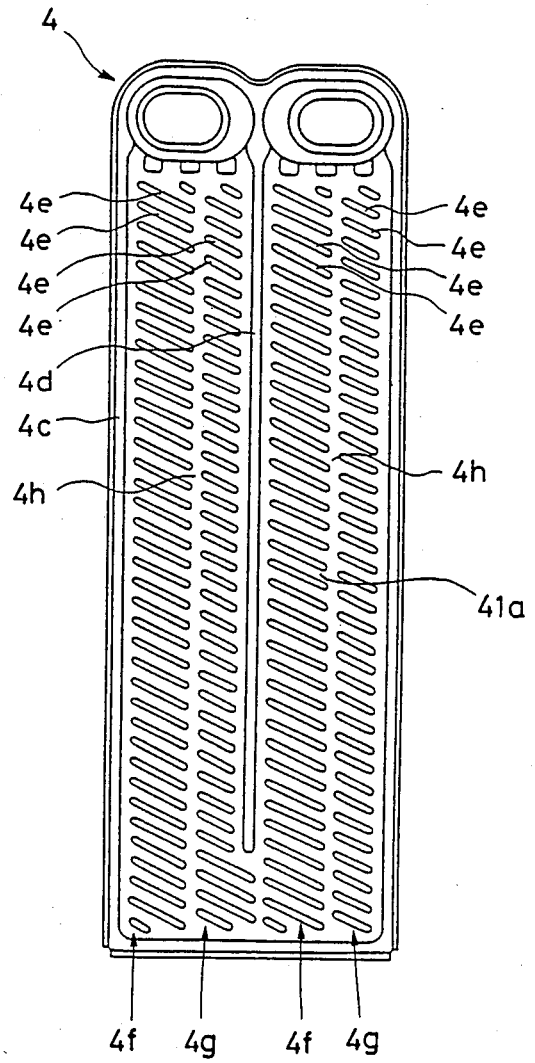
FIG. 2 is a front elevational view of a core plate for use in a heat exchanger according to the present invention.

As shown in FIG. 2; each core plate 4 is of an elongate configuration having an inlet/outlet hole 4*a* defined in one end thereof for connection to the inlet tank 42 and another inlet/outlet hole 4*b* defined in the same end in juxtaposed relation to the inlet/outlet hole 4*a* for connection to the outlet tank. The core plate 4 is brazed to the companion core plate 4 (not shown in FIG. 2) along a peripheral edge 4*c*. The core plate 4 has a central longitudinal partition 4*d* extending from the upper edge thereof and terminating short of the lower edge so that the fluid flow pass 41*a* is of a U-shaped configuration with its upper ends communicating with the inlet/-outlet holes 4*a*, 4*b*. The core plate 4 has on its inner wall surface different groups 4*f*, 4*g* of ribs 4*e* extending obliquely to the longitidinal direction of the core plate 4, i.e., the direction of the fluid flow pass 41*a*. The ribs 4*e* of each of the two groups 4*f* are generally longer than the ribs 4*e* of each of the two groups 4*g*. The rib groups 4*f*, 4*g* alternate with each other in the transverse direction of the core plate 4. Two adjacent rib groups 4*f*, 4*g* are positioned on one side of the central partition 4*d*, whereas the other two adjacent rib groups 4*f*, 4*g* are located on the other side of the central partition 4*d*. On each side of the central partition 4*d*, a fluid flow passage 4*h* is defined between the rib groups 4*f*, 4*g*. The rib groups 4*f*, 4*g* are asymmetrical with respect to the central axis of the U-shaped fluid flow pass 41*a*. Therefore, the different lengths of the ribs 4*e* are asymmetrical with respect to the central axis of the U-shaped fluid flow pass 41*a*.

Figure 4:
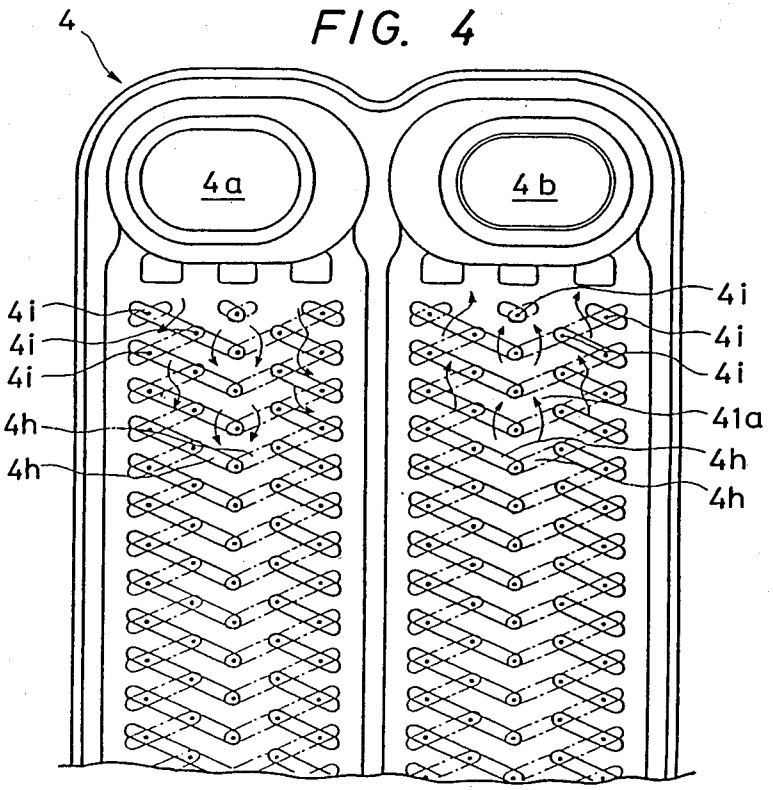
FIG. 4 is an enlarged fragmentary front elevational view of the joined core plates shown in FIG. 3.
Figure 3:
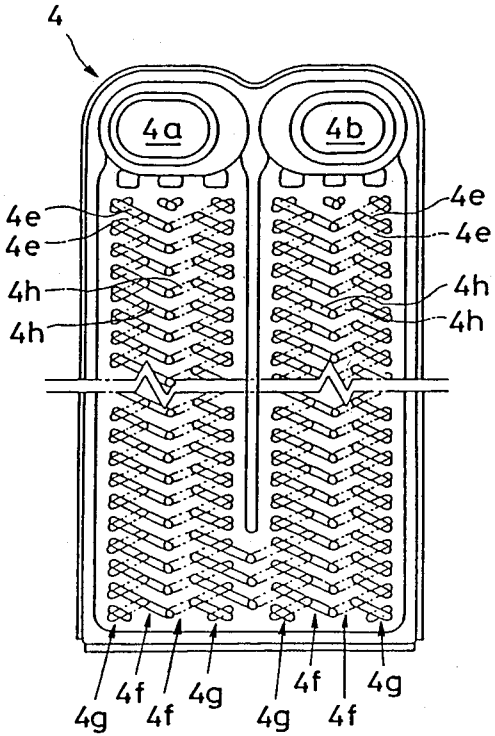
FIG. 3 is a fragmentary front elevational view of a pair of joined core plates of FIG. 1 which define a fluid flow pass therebetween.

When the two core plates 4 are joined together, as shown in FIG. 3, the fluid flow passages 4*h* on one of the core plates 4 do not overlap the fluid flow paths 4*h* on the other core plate 4, so that there is not provided any fluid flow passage having no rib 4*e* on each of the core plates 4. With the two core plates 4 coupled to each other, the confronting ribs on the core plates 4 intersect, as illustrated in FIGS. 3 and 4, and have their end surfaces joined to thereby strengthen the fluid flow tube 41 and create tortuous paths for the passage of the fluid through the fluid flow pass 41*a*. The end surfaces of the ribs 4*e* lie flush with those of the peripheral edge 4*c* and the partition 4*d* so that the end surfaces of the confronting ribs 4*e* will be held in contact with each other when the core plates 4 are brazed together. The angle at which the ribs 4*e* are inclined to the direction of the fluid flowing through the fluid flow pass 41*a* is selected to allow the fluid to flow at a suitable speed in the fluid flow pass 41*a* and to cause the fluid to be stirred in the fluid flow pass 41*a* for increased thermal transfer efficiency. The ribs 4*e* can be formed at the same time that the core plate 4 is formed.

As shown in FIG. 1, the opposite outer sides of the evaporator 1 are protected by side plates 5 that are brazed to outermost corrugated fins 6. Corrugated fins 6 are interposed between adjacent ones of the fluid flow tubes 41 for increasing the surface area of the fluid flow tubes 41 which air flowing between the fluid flow tubes 41 contacts. The corrugated fins 6 are formed by pressing a lightweight sheet of aluminum or brass which is of a good thermal conductor into a corrugated shape.

The manner in which the evaporator 1 is assembled will be described below. The core plates 4 which have already been clad with a brazing material on their opposite surfaces, the corrugated fins 6 which have not been clad with any brazing material, and the side plates 5 which have been clad with a brazing material on only surfaces thereof to be held against the outermost corrugated fins 6, are put together as shown in FIG. 1. More specifically, the core plates 4 and the corrugated fins 6 are alternately stacked on one of the side plates 5, and finally the other side plate 5 is applied. The assembly is securely held together by a jig (not shown), and placed in a heated brazing furnace (not shown) in which the assembly is kept for a predetermined period of time to melt the brazing material. After the assembly is brazed and cooled, the pipes 2, 3 are brazed to the assembly. The confronting ribs 4*e* are brazed to each other by a brazing spot 4*i* (FIG. 4).

The evaporator 1 thus assembled is installed in an automotive air conditioner with the pipes 2, 3 connected to the compresser. When the compresser is driven, an atomized refrigerant of low temperature flows into the inlet tanks 42 through the pipe 2. The refrigerant is then delivered from the inlet tanks 42 into the fluid flow passes 41*a* in the fluid flow tubes 41. The refrigerant supplied into the fluid flow passes 41*a* flows through the tortuous paths as indicated by the arrows in FIG. 4 and is stirred therein by the ribs 4*e* while being subjected to resistance to its flow. Now, heat transfer occurs between the refrigerant flowing through the fluid flow passes 41*a* and air flowing through the corrugated fins 6 between the fluid flow tubes 41 and along the surfaces of the core plates 4 and the corrugated fins 6. The air that has passed through the corrugated fins 6 is cooled down to cool the passenger's compartment. The refrigerant that has passed through the fluid flow passes 41*a* is collected into the outlet tanks, from which it flows into the compressor.

Since the refrigerant is forced to flow through the tortuous paths in each of the fluid flow passages 41*a*, the heat transfer efficiency of the fluid flow tubes 41 is increased. The fluid flow tubes 41 are highly mechanically strong and pressure-resistant inasmuch as they do not have passages free of ribs.

Figure 5:
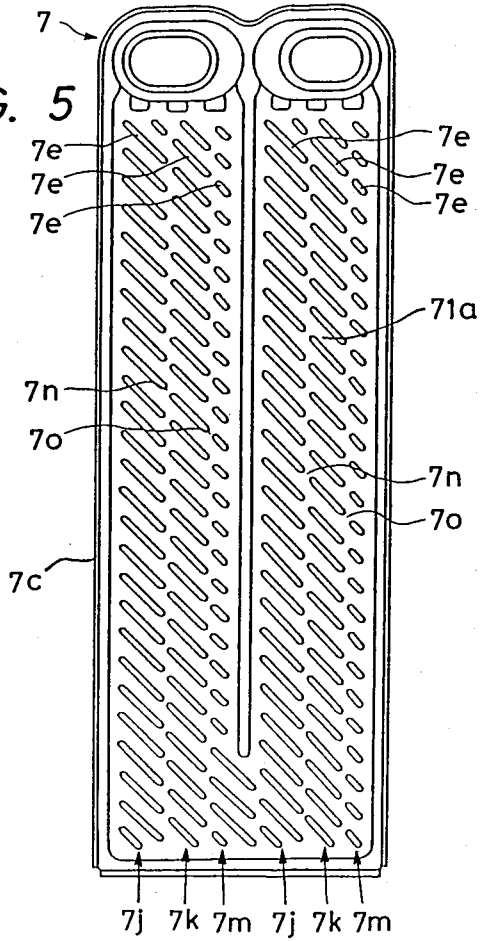
FIG. 5 is a front elevational view of a core plate according to another embodiment of the present invention.

FIG. 5 illustrates a core plate according to another embodiment of the present invention. The core plate, generally denoted at 7, has a group 7*j* of longer ribs 7*e*, a group 7*k* of medium ribs 7*e*, and a group 7*m* of shorter ribs 7*e* on each side of a central partition 7*d*. The rib groups 7*j*, 7*k*, 7*m* on the core plate 7 are asymmetrical with respect to the central axis of a U-shaped fluid flow pass 71*a*. Rib-free passages 7*n*, 7*o* are defined between the rib groups 7*j*, 7*k* and between the rib groups 7*k*, 7*m* on each side of the central partition 7*d*. When two core plates 7 are joined to each other along their peripheral edges 7*c*, these rib-free passages 7*n*, 7*o* do not overlap each other, creating tortuous flow paths in the fluid flow pass 71*a*.

Figure 6:
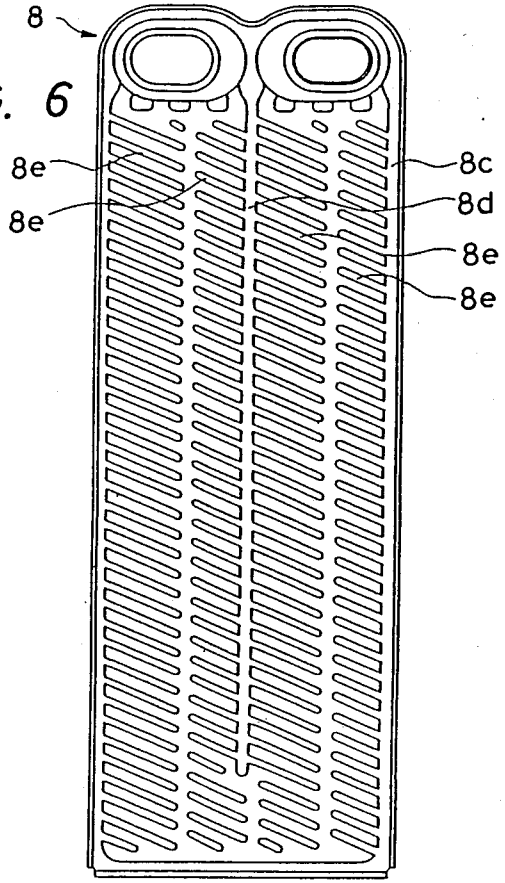
FIG. 6 is a front elevational view of a core plate according to still another embodiment of the present invention.

A core plate 8 according to still another embodiment shown in FIG. 6 differs from the core plate 4 of FIG. 2 in that ribs 8*e* adjacent to a central partition 8*d* are joined to the central partition 8*d* and ribs 8*e* adjacent to a peripheral edge 8*c* are joined to the peripheral edge 8*c*. With this arrangement, the heat transfer efficiency is much better since there is no straight rib-free passage defined along the central partition 8*d* and the peripheral edge 8*c*.

Figure 7:
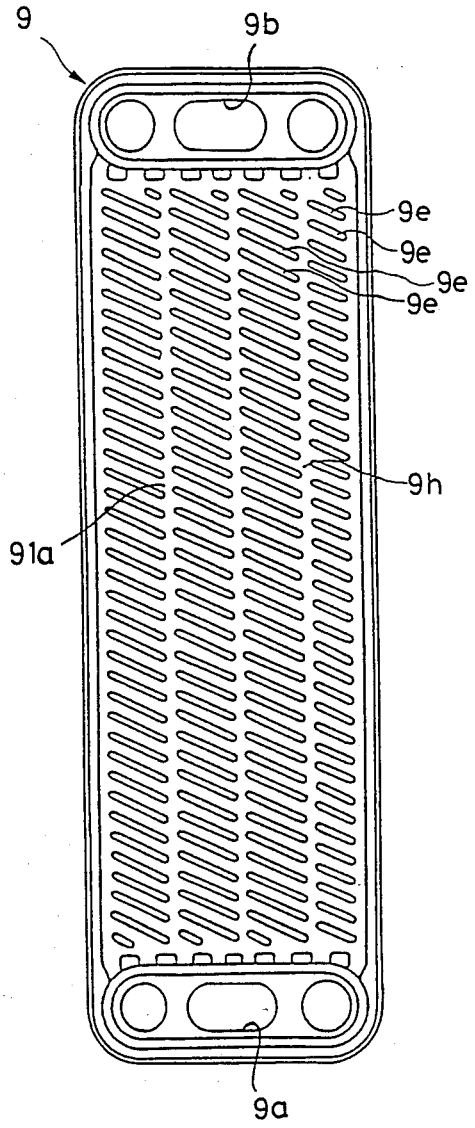
FIG. 7 is a front elevational view of a core plate according to a still further embodiment of the present invention.

FIG. 7 shows a still further embodiment in which a core plate 9 has no central partition and a straight fluid flow pass 91*a* extends between an inlet/outlet hole 9*a* on one end of the core plate 9, to be connected to an inlet tank (not shown), and an inlet/outlet hole 9*b* on the other end to be connected to an outlet tank (not shown). The core palte 9 has three rows or groups of longer ribs 9*e* and one row or group of shorter ribs 9*e*. These rib groups are asymmetrical with respect to the central axis of the fluid flow pass 91*a*, so that longitudinal rib-free passages 9*h* on the two joined core plates 9 do not overlap each other, and the fluid flow pass 91*a* defined between two joined core plates 9 does not have fluid flow passages free of ribs.

The side plates 5, the core plates 4, and the corrugated fins 6 may be joined by adhesive bonding, soldering, or other joining techniques, rather than the brazing.

In FIG. 1, the pipes 2, 3 may be positioned on one side of the evaporator 1 for supplying and discharging the refrigerant to the inlet tanks 42 and from the outlet tanks.

In the illustrated embodiments, each of the core plates has a rib-free passage between adjacent rib groups or rows. However, each of the core plates need not have such a rib-free passage between adjacent rib groups or rows. Furthermore, while each of the illustrated core plates does not have a rib-free passage extending across the direction of flow of the fluid, it may have a rib-free passage across the direction of flow of the fluid, and such rib-free passages may be arranged such that they will not overlap each other when two companion core plates are joined together.

The plate-type heat exchanger of the present invention may be employed as a refrigerant condenser or evaporator for home or industrial use, rather than automotive use, or may be used in an engine radiator, a heater core, an oil cooling device, or other any devices which effect heat transfer between different fluids.

Although certain preferred embodiments of the present invention have been shown and described in detail, it should be understood that various changes and modifications may be made therein without departing from the scope of the appended claims.

What is claimed is:

1. A plate-type heat exchanger comprising a stack of flat fluid flow tubes each composed of a pair of confronting core plates joined to each other and defining a fluid flow pass therebetween, each of said core plates having an inlet hole for introducing a fluid into said fluid flow pass and an outlet hole for discharging the fluid from said fluid flow pass, said core plate having a plurality of ribs on an inner wall surface thereof which project into said fluid flow pass, said ribs on each of said pair of core plates being grouped in plural rows along said fluid pass and being held in contact with the confronting ribs of at least two rows on the other core plate, so that there is no rib-free line along said fluid flow pass, and one end of each of said ribs in one row being positionally displaced from one end of an adjacent one of said ribs in another row along said fluid flow pass, so that there is no transverse rib-free line across the fluid flow pass.

2. A plate-type heat exchanger according to claim 1, wherein said rows of the ribs are assymmetrical with respect to the central axis of said fluid flow pass.

3. A plate-type heat exchanger according to claim 2, wherein lengths of said ribs of the different rows are asymmetrical with respect to the central axis of said fluid flow pass.

4. A plate-type heat exchanger according to claim 1, wherein each said core plate has a central partition extending from one end thereof and terminating short of the other end thereof, thereby defining said fluid flow pass as a U-shaped configuration, said ribs in different rows having different lengths on each side of said central partition.

5. A plate-type heat exchanger according to claim 4, wherein said ribs in different rows on each side of said central partition are of longer, medium, and shorter lengths.

6. A plate-type heat exchanger according to claim 4, wherein said confronting core plates are joined to each other at their peripheral edges, the ribs adjacent to said peripheral edge and said central partition on each of said core plates being joined to said peripheral edge and said central partition.

7. A plate-type heat exchanger according to claim 1, wherein said inlet and outlet holes are defined in one end of each of said core plates in juxtaposed relation to each other.

8. A plate-type heat exchanger according to claim 1, wherein said inlet and outlet holes are defined in opposite ends, respectively, of each of said core plates.

* * * * *